US007464490B2

(12) United States Patent
Lebo

(10) Patent No.: US 7,464,490 B2
(45) Date of Patent: Dec. 16, 2008

(54) MULTILAYERED SOLE

(75) Inventor: Jonathan K. Lebo, Lebanon, PA (US)

(73) Assignee: Columbia Insurance Company, Omaha, NE (US)

( * ) Notice: Subject to any disclaimer, the term of this patent is extended or adjusted under 35 U.S.C. 154(b) by 386 days.

(21) Appl. No.: 11/146,249

(22) Filed: Jun. 6, 2005

(65) Prior Publication Data

US 2006/0277799 A1 Dec. 14, 2006

(51) Int. Cl.
*A43B 13/12* (2006.01)

(52) U.S. Cl. ..... 36/30 R; 36/25 R; 36/102

(58) Field of Classification Search ..... 36/25 R, 36/30 R, 102, 44, 28
See application file for complete search history.

(56) References Cited

U.S. PATENT DOCUMENTS

| | | | | | |
|---|---|---|---|---|---|
| 1,401,981 | A * | 1/1922 | Hill | 36/31 |
| 2,345,551 | A * | 4/1944 | Audino | 36/31 |
| 2,369,531 | A * | 2/1945 | Caltabiano | 36/31 |
| 2,411,850 | A * | 12/1946 | Caratozzolo | 36/22 R |
| 3,952,429 | A * | 4/1976 | Thomas | 36/31 |
| 4,364,189 | A * | 12/1982 | Bates | 36/31 |
| 4,400,894 | A * | 8/1983 | Ehrlich | 36/33 |
| 4,615,126 | A * | 10/1986 | Mathews | 36/102 |
| 4,624,061 | A * | 11/1986 | Wezel et al. | 36/30 A |
| 4,642,911 | A * | 2/1987 | Talarico, II | 36/30 R |
| RE32,394 | E * | 4/1987 | Ehrlich | 36/33 |
| 4,730,402 | A * | 3/1988 | Norton et al. | 36/30 R |
| 4,779,361 | A * | 10/1988 | Kinsaul | 36/102 |
| 4,794,707 | A * | 1/1989 | Franklin et al. | 36/107 |
| 4,837,949 | A * | 6/1989 | Dufour | 36/127 |
| 4,864,739 | A * | 9/1989 | Maestri | 36/43 |
| 5,832,634 | A * | 11/1998 | Wong | 36/107 |
| 6,061,929 | A * | 5/2000 | Ritter | 36/107 |
| 6,079,125 | A * | 6/2000 | Quellais et al. | 36/25 R |
| 7,124,519 | B2 * | 10/2006 | Issler | 36/31 |
| 7,178,271 | B2 * | 2/2007 | Covatch | 36/102 |
| 7,210,250 | B2 * | 5/2007 | Gallegos | 36/44 |
| 2005/0150134 | A1 * | 7/2005 | Issler | 36/102 |
| 2006/0053657 | A1 * | 3/2006 | Ailey et al. | 36/44 |
| 2006/0107552 | A1 * | 5/2006 | Clark et al. | 36/97 |
| 2006/0107553 | A1 * | 5/2006 | Clark et al. | 36/97 |
| 2007/0144038 | A1 * | 6/2007 | Ailey et al. | 36/44 |

* cited by examiner

*Primary Examiner*—Marie Patterson
(74) *Attorney, Agent, or Firm*—St. Onge Steward Johnston & Reens LLC

(57) ABSTRACT

The invention relates to a multilayered sole having an insole extending from a toe area to a heel area and having a rigid member and a flexible member for enhancing flexibility. The multilayered sole also includes a midsole extending from the toe area to the heel area and having a cushioning material and a structural material for enhancing comfort. The insole and midsole are then combined with an outsole.

17 Claims, 5 Drawing Sheets

MULTILAYERED SOLE

FIELD OF THE INVENTION

The invention relates to a multilayered sole where each layer includes a plurality of members for enhancing flexibility and cushioning.

BACKGROUND OF THE INVENTION

A variety of different sole constructions are used by the footwear industry. For the most part, each sole construction has characteristics that make it particularly well-suited for specific applications. For example, some constructions are selected for their durability, others for their comfort, while still others are selected for their aesthetic appeal.

Some shoes typically have enhanced cushioning, which may result in a softer feel to a user's foot. Moreover, cushioning may be used or enhanced in any area of the shoe. Generally, the more cushioning, the softer the shoe feels to the user, resulting in improved comfort. However, increasing cushioning may lead to an increased likelihood of retaining moisture and/or bacteria in the cushioning material. Therefore, adding cushioning may also disadvantageously introduce odors or fungi.

Some footwear often comprises a midsole, where an upper is attached to a top surface of the midsole and a wear surface is attached to a bottom surface of the midsole. Because the wear surface is usually in contact with the ground, the midsole need not be, and is often not, made of a material as tough or rigid as the wear surface. However, because the midsole should resist breaking down while providing structural integrity in connecting the upper and wear surface, as well as support to the shoe, the midsole is generally tougher than cushioning material. In other types of footwear, the midsole and wear surface are combined and such combination is usually called an outsole.

Whether a shoe uses a midsole or outsole, consumers often use comfort as at least one basis for purchasing a particular shoe over a competitor's shoe. Therefore, manufacturers have longed to improve comfort of their shoes, which is often achieved by placing resilient or cushioning material between a user's foot and a top surface of the midsole or outsole. However, due to repeated foot strikes, particularly in the heel and balls of the foot areas, the cushioning material often breaks down or becomes flattened. In some cases, the breakdown of the cushioning is so severe that the user may discard the shoe even though other parts of the shoe are usable.

In other types of footwear, an insole may be provided in direct contact with the upper around a periphery of the insole so as to form a cavity into which a foot may be placed. The midsole may be in direct contact with the bottom of the insole to secure the wear surface to the insole and upper. For stitched shoes, the midsole may be sewn to the insole. In cemented shoes, the midsole may be adhered to the insole.

Similar to the midsole, the insole is often of a rigid material so that it may provide adequate structural integrity and be capable of being stitched. However, since the insole is not in contact with the ground, it need not be as tough as the wear material.

Therefore, since both the insole and midsole are typically used to provide structural integrity, their ability to provide cushioning and/or flexibility may be limited.

U.S. Pat. No. 2,598,297 ("Pierson") appears to relate to a cushioned insole. However, Pierson may not address the midsole's cushioning and/or flexibility.

U.S. Pat. No. 4,930,232 ("Engle") appears to relate to a multilayered sole for enhancing comfort. However, Engle seems to rely upon the combination of layers to provide overall relief but may not address the need to improve the cushioning and/or flexibility of each of the individual layers, such as the insole or midsole. Engle may also not address the build up of fungi or odors in its layers of cushioning materials.

U.S. Pat. No. 4,979,318 ("Cohen"), U.S. Pat. No. 5,014,706 ("Philipp") all seem to relate to orthodics and, in some cases, flexible orthodics. However, these patents do not seem to enhance comfort and/or flexibility of the midsole and the insole.

U.S. Pat. No. 4,908,961 ("Purslow"), U.S. Pat. No. 2,691,227 ("Sachs"), U.S. Pat. No. 492,994 ("Sawyer"), U.S. Pat. No. 1,947,031 ("Bain"), U.S. Pat. No. 4,633,877 ("Pendergast"), and U.S. Pat. No. 4,627,177 ("Meyers") all seem to relate to insoles but may not address the midsole's flexibility and/or cushioning.

What is desired, therefore, is an insole with improved flexibility and cushioning without sacrificing structural integrity. Another desire is a midsole with improved flexibility and cushioning without sacrificing structural integrity. Yet another desire is an insole and midsole that provides enhanced cushioning while reducing odors and bacteria.

SUMMARY OF THE INVENTION

It is, therefore, an object of the invention to provide a shoe with improved flexibility or cushioning without sacrificing structural integrity.

Another object of the invention is to provide a shoe with improved cushioning while reducing bacteria or odor accumulation.

These and other objects of the invention are achieved by a multilayered sole having an insole extending from a toe area to a heel area and having a rigid member and a flexible member for enhancing flexibility. The multilayered sole also includes a midsole extending from the toe area to the heel area and having a cushioning material and a structural material for enhancing comfort. The insole and midsole are then combined with an outsole.

The cushioning material may extend a length or a width of the midsole and may be a gel whereas the structural material may be leather.

In some embodiments, the rigid member is alternately placed with the flexible member. In other embodiments, the cushioning material is alternately placed with the structural material.

Optionally the insole may gradually transition from the rigid member to the flexible member, where a thickness of the rigid member is inversely proportional to a thickness of the flexible member in an area of gradual transition from the rigid member to the flexible member.

Likewise, the midsole may optionally and gradually transition from the cushion material to the structural material, where a thickness of the cushion material is inversely proportional to a thickness of the structural material in an area of gradual transition from the cushion material to the structural material.

In another aspect of the invention, the multilayered sole includes an outsole with a recess where the recess extends laterally across the outsole and slopes downwardly toward a rear of the outsole. The flexible member of the insole and the cushion material of the midsole are placed proximate to the recess, where the flexible member and cushion material flex in cooperation with the recess for enhancing flexibility of the multilayer outsole.

Optionally, the multilayered sole may include a notch in a top surface of the outsole for enhancing flexibility. In some embodiments, the multilayered sole has a plurality of recesses. In still further embodiments, the recess is between a top surface and a bottom surface of the outsole. In other embodiments, the recess extends from a top surface of the outsole toward a bottom surface of the outsole. In yet other embodiments, the recess extends from a top surface to a bottom surface of the outsole.

DETAILED DESCRIPTION OF THE DRAWINGS

Figure 1:
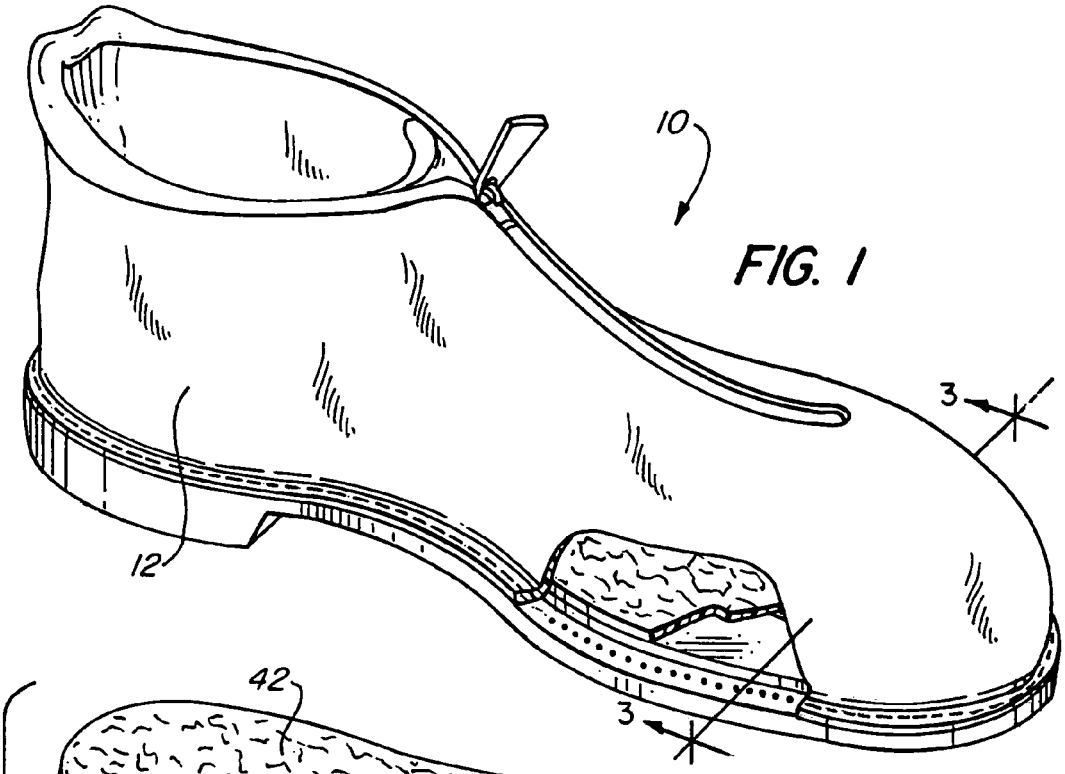
FIG. 1 depicts the shoe in accordance with the invention.

FIG. 1 depicts multilayered sole 20 in accordance with the invention. Multilayered sole 20 includes insole 40, midsole 60, and outsole 80, where insole 40 and midsole 60 further include multiple pieces so that the overall flexibility and/or comfort of multilayered sole 20 may be enhanced. Multilayered sole 20 is attached to upper 12 to complete shoe 10.

Figure 2:
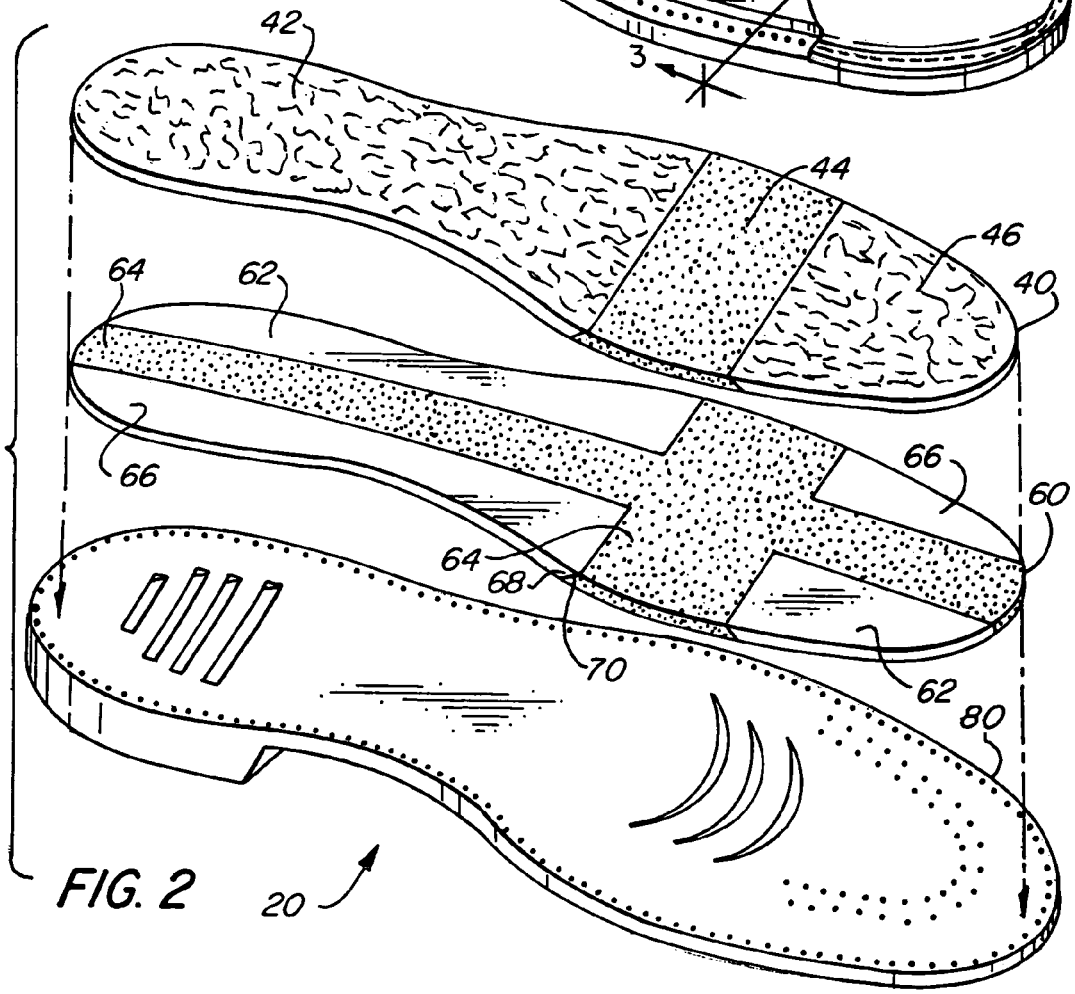
FIG. 2 depicts an assembly view of the shoe shown in FIG. 1.

As shown in FIG. 2, insole 40 includes rigid member 42 and flexible member 44, where flexible member 44 enhances flexibility of insole 40 and where rigid member 42 provides structural integrity to insole 40. Rigid member 42 is placed adjacent to flexible member 44 and this is followed by another rigid member 46. Although rigid members 42, 46 may be adjacently placed and may enhance flexibility of insole 40 due to there being a gap or separation or division between rigid members 42, 46, flexibility is greater when placing a rigid member alternately with a flexible member.

Insole 40 is often secured to both an upper of the shoe and outsole 80. Hence, insole 40 is a significant element of shoe 10 because a weak, or lack of structural integrity in, insole 40 may cause the upper or outsole 80 to separate from insole 40 since any fastener or stitch, which may be used to secure the upper or outsole 80 to insole 40, would lack an anchoring mechanism to which to be secured.

For example, if a screw or rivet is used to secure insole 40 to outsole 80, the hole through which the screw or rivet passes may stretch around and loosen insole 40 from the screw or rivet.

Therefore, insole 40 is made of a rigid material having sufficient structural integrity to provide an anchoring mechanism to which the upper and/or outsole 80 is secured.

Similarly, midsole 60 also includes structural material 62 and cushioning material 64, where cushioning material 64 enhances flexibility of midsole 60 and where structural material 62 provides structural integrity to insole 60. Similar to insole 40, structural material 64 is placed alternately adjacent to cushioning material 64, and vice versa. Although midsole 60 would still provide flexibility if structural material 62 was placed next to another structural material 66, alternating a structural material with a cushioning material provides enhanced flexibility.

Structural material 62, cushioning material 64, rigid member 42, and flexible member 44 may include any geometric shape, including those depicted or any other variation so long as insole 40 includes both rigid member 42 and flexible member 44, preferably adjacent to or placed in alternating fashion with one another, and so long as midsole 60 includes both structural material 62 and cushioning material 64, preferably adjacent to or placed in alternating fashion with one another. It should be known that another rigid member 46 and another structural material 66 include the same limitations as rigid member 42 and structural material 62, respectively, and will not be described further.

As shown, flexible member 44 extends across an entire width of insole 40. Cushioning material 64 extends across an entire width and length of midsole 60. Flexible material 44 is any leather, gel, foam, EVA foam, visco elastic foam, or other malleable, soft fabric for improving flexibility to insole 40. Cushioning material 64 is any gel, EVA foam, or other soft material for improving flexibility to midsole 60. Moreover, the materials for flexible material 44 and cushioning material 64 may be the same as each other.

Because structural integrity is also needed for both insole 40 and midsole 60, rigid member 42 and structural material 62 are made of rough or strong materials. Rigid member 42 is any texon board, fiber board, or other similarly strong substance. Structural material 62 is any leather, rubber, and the like. In some embodiments, the material for rigid member 42 and structural material 62 are the same.

As shown in FIGS. 1-2, flexible member 44 is proximately placed with cushioning material 64, in which case overall flexibility of multilayered sole 20 may be maximized as flexible member 44 and cushioning material 64 are in cooperation with one another.

Furthermore, flexible member 44 and cushioning material 64 may be placed proximate to recess 120 or notch 130 in outsole 80 for further enhancement of overall flexibility to multilayered sole 20. Recess 120 and notch 130 are described below.

Optionally, as shown in FIG. 2, structural material 62 may include sloped edge 68 and cushioning material 64 may include angled edge 70 so that when structural material 62 and cushioning material 64 are joined together, there is an increased contact point to more adequately secure structural material 62 to cushioning material 64. In the event structural material 62 is adhered to cushioning material 64, sloped edge 68 and angled edge 70 provides an increased surface area to which adhesive may be applied, which would lead to improved adherence between structural material 62 and cushioning material 64. As shown, sloped edge 68 gradually increases in thickness as angled edge 70 decreases in thickness, meaning the two edges have an inversely proportional relationship of thicknesses. Optionally, rigid member 42 and flexible member 44 may also have a corresponding sloped edge and angled edge for enhanced securement to one another.

Other manners for securing structural material 62 to cushioning material 64 include sewing them together with a stitch or fastening them together with a screw or rivet. Another manner for securement may include a hook and loop fastening system, such as Velcro™.

Figure 4:
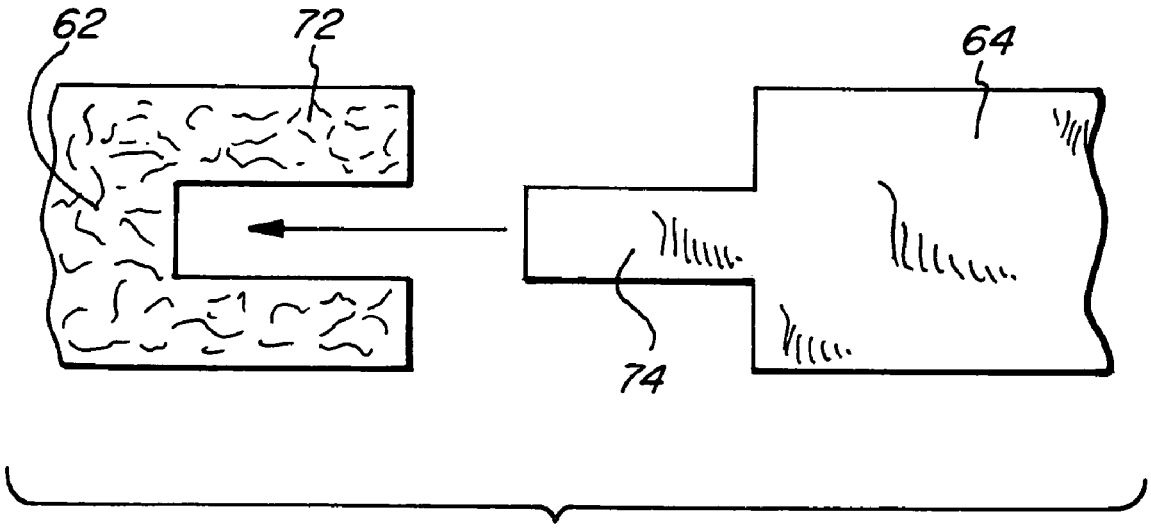
FIG. 4 depicts an alternative connection between the flexible material and structural material shown in FIG. 1.

In an alternative embodiment, shown in FIG. 4, the attachment of cushioning material 64 and structural material 62 may be by a tongue and groove relationship where structural 62 may have a C-shaped edge 72 and where cushioning material 64 may have protrusion 74 shaped to fit within C-shaped edge 72. A fastener or stitch may then be used to penetrate through C-shaped edge 72 and protrusion 74. In a further embodiment, adhesive or hook and loop fasteners may be applied to the contact surfaces between C-shaped edge 72 and protrusion 74 instead of or in addition to a fastener or stitch. It is understood that insole 40 may also include a corresponding C-shaped edge and protrusion for more adequately securing rigid member to flexible member.

Figure 3:
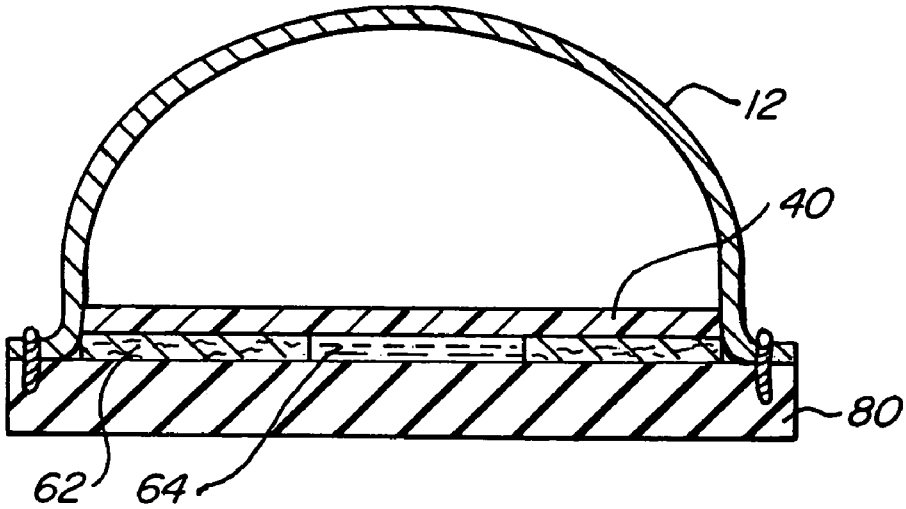
FIG. 3 depicts a cross sectional view of the shoe shown in FIG. 1.

FIG. 3 depicts a cross sectional view of multilayered sole 20 in accordance with the invention.

Although it is shown insole 40 includes a plurality of members, where the plurality of members include rigid member 42 alternately placed with flexible member 44, and midsole 60 includes a plurality of materials, where the plurality of materials include cushioning material 64 alternately placed with structural material 62, the invention also considers insole 40 including a plurality of materials, where plurality of materials further include cushion material 64 alternately placed with structural material 62, and midsole 60 including a plurality of members, where plurality of members further include rigid member 42 alternately placed with flexible member 44.

Figure 5:
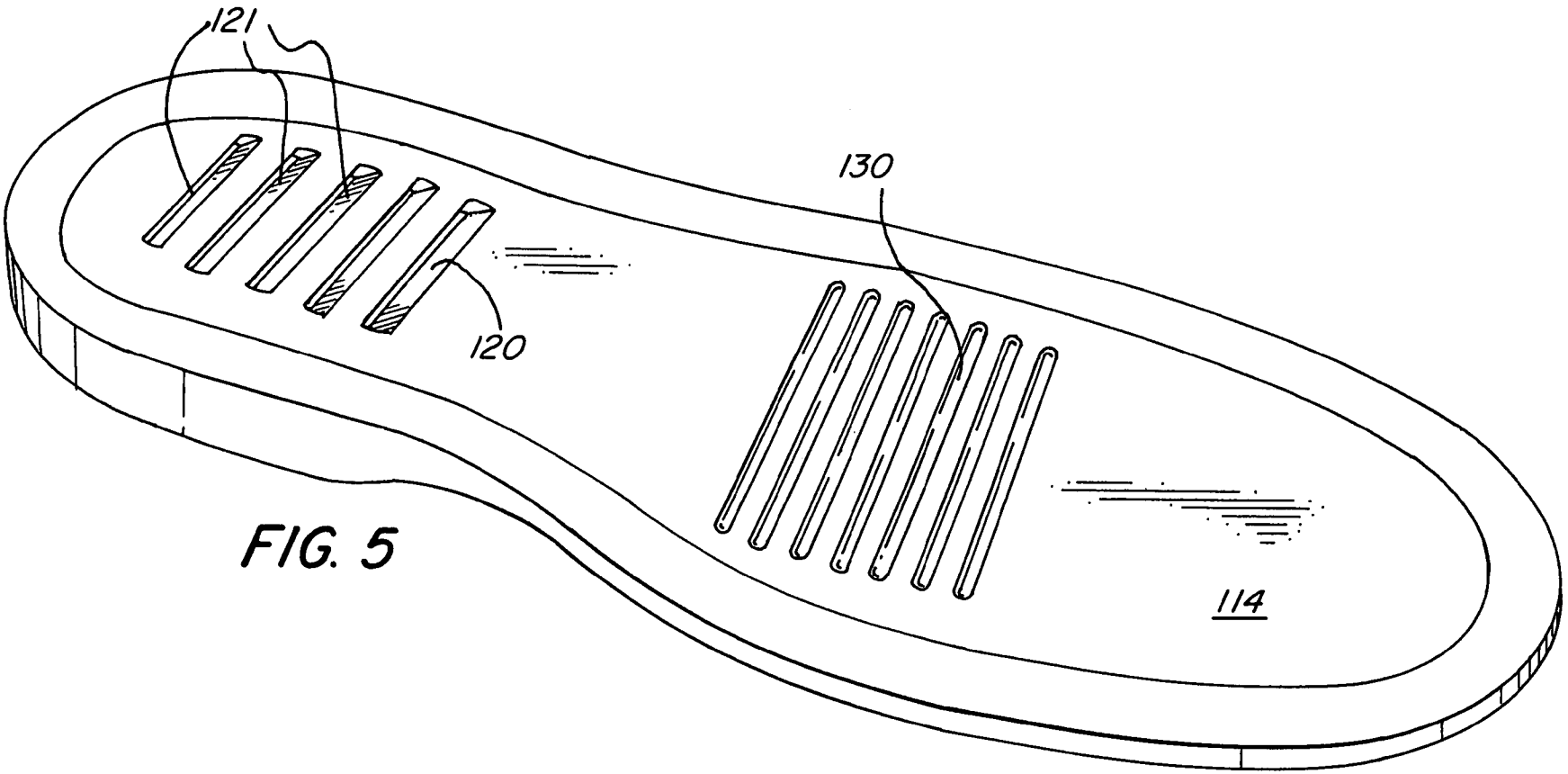
FIG. 5. more particularly depicts the outsole shown in FIG. 1.

FIG. 5 depicts improved outsole 80 in accordance with the invention. As shown, outsole 80 includes recess 120 and notch 130. Recess 120 improves the cushioning effect of outsole 80 as outsole 80 is compressed by the user's foot. The greater the quantity of recess 120, the more enhanced the cushioning effect. In this fashion, the material of outsole 80 may play less of a role in the amount of comfort outsole 80 provides, and the overall shoe of which outsole 80 is a part, because even a tough or brittle material may provide enhanced cushioning to the user's foot due to recess 120 or plurality 121 of recesses.

Figure 6:
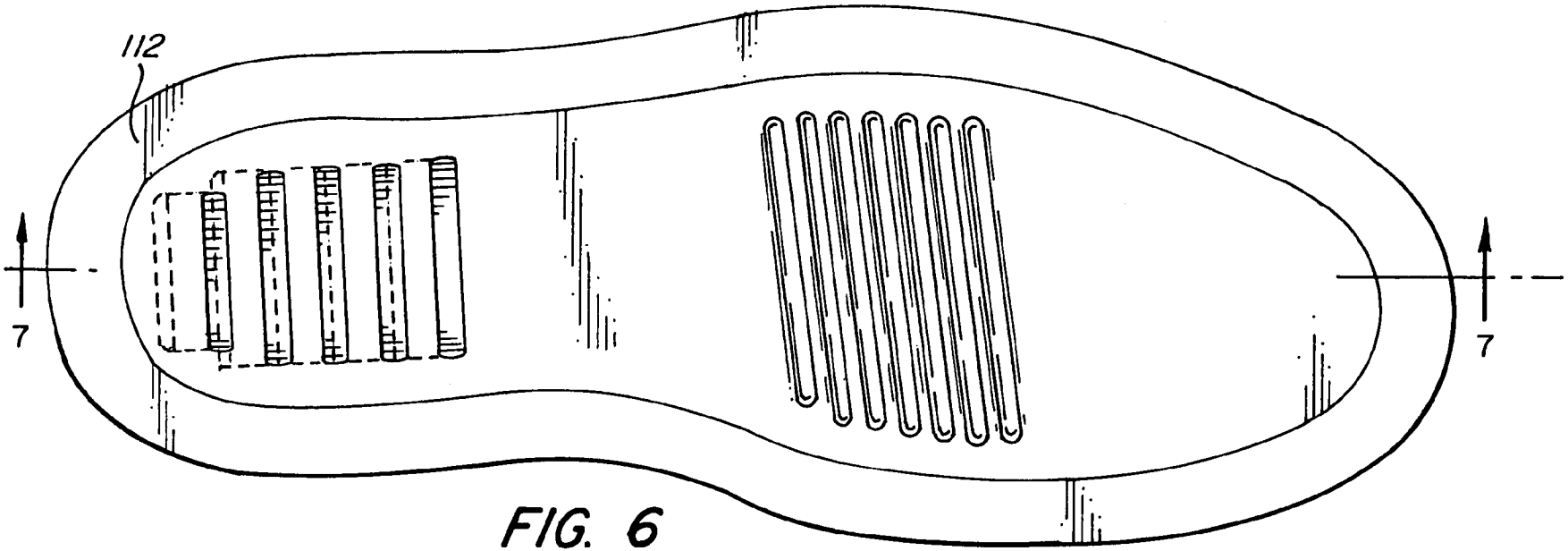
FIG. 6 is a top view of the outsole shown in FIG. 1.
Figure 7:
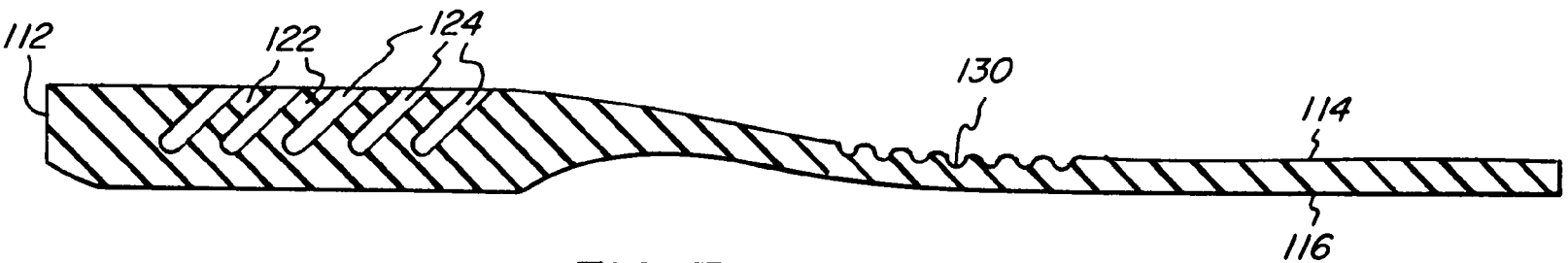
FIG. 7 depicts a cross sectional view of the outsole of FIG. 1.

Referring to FIGS. 5-7, the cushioning effect of recess 120 lies in the angle of recess 120 as recess 120 slopes rearwardly and downwardly toward rear 112 of outsole 80. The angle of recess 120 is between approximately 30° and approximately 60° degrees with top surface 114, more preferably between approximately 40° and approximately 50° degrees with top surface 114, and most preferably the angle of recess 120 is approximately 45°.

As the user's foot compresses outsole 80, and more specifically recess 120, the walls 122 of recess 120 yields, or partially collapse, into void 124 formed by recess 120. The yielding of walls 122 act like a shock absorber. Plurality 121 of recesses further enhance the cushioning effect of sole 120 because additional voids 124 distribute and absorb a greater amount of weight caused by the user's foot by dispersing the weight across many voids 124 as opposed to one void 124.

As shown, although recess 120 is depicted to extend from top surface 114 of outsole 80 and slope rearwardly, in other embodiments, recess 120 may be embedded within outsole 80 where recess 120 extends downwardly and rearwardly from a point between top and bottom surfaces 114, 116 to another point between top and bottom surfaces 114, 116.

Also shown in FIGS. 5-7, is notch 130 in top surface 114. Notch 130 is an absence of material from top surface 114. Less material in outsole 80 permits outsole 80 to bend more easily since there is less resistance.

Figure 8:
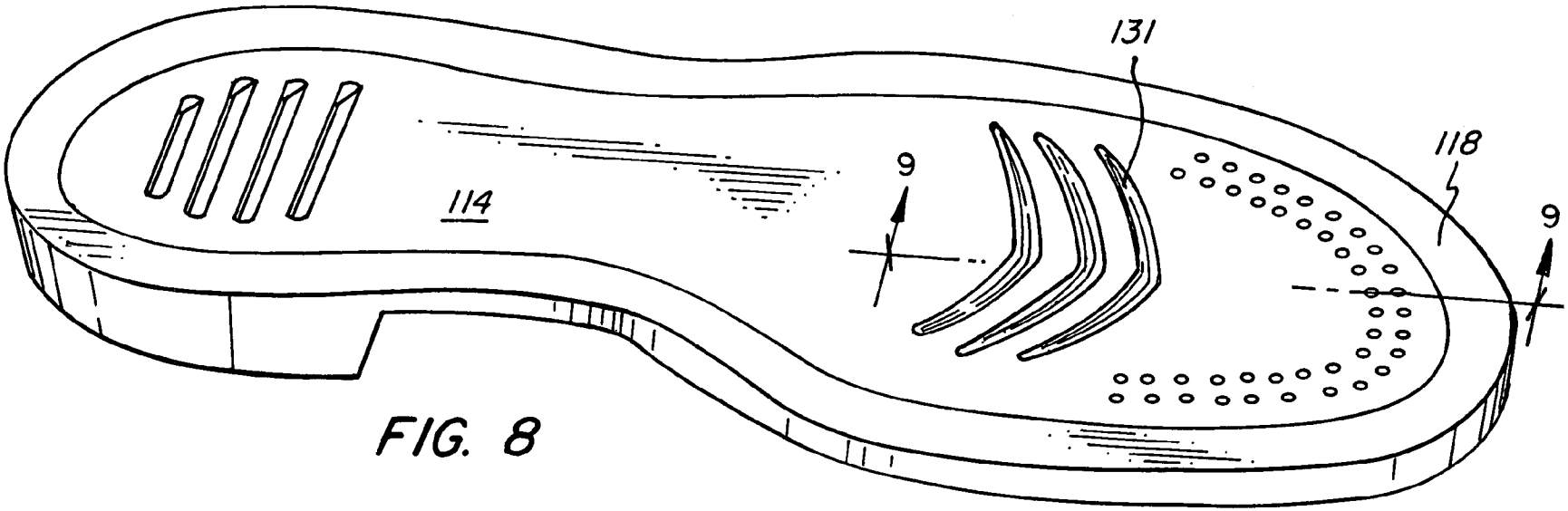
FIG. 8 depicts an alternative embodiment of the outsole of FIG. 1.
Figure 9:
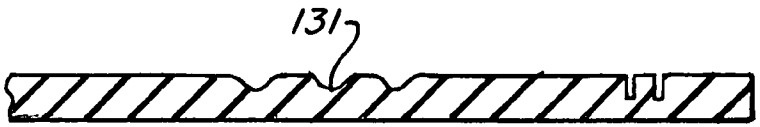
FIG. 9 depicts a cross sectional view of the outsole shown in FIG. 1.

FIG. 8 depicts notch 131 being curved or angled about an axis perpendicular to top surface 114, so that multilayered sole 20 may more easily flex in the direction of the curve or angle. This variance of notch 131 from notch 130 may be advantageous for a user who moves or desires flexing in directions other than toward front part 118 of outsole 80, such as a user who participates in athletic activities. FIG. 9 more particularly shows curved notch 131.

What is claimed is:

1. A multilayered sole, comprising:

an insole extending from a toe area to a heel area and having a rigid member and a flexible member for enhancing flexibility;

a midsole extending from the toe area to the heel area and having a cushioning material and a structural material for enhancing comfort;

said structural material includes a top surface, a bottom surface, and an edge defined by a shortest distance between said top and bottom surfaces of said structural material, said edge of said structural material having a recess that extends along the edge and does not intersect the top and bottom surfaces;

said cushioning material includes a top surface, a bottom surface and an edge defined by a shortest distance between said top and bottom surfaces of said cushioning material, said edge of said cushioning material having a protrusion that extends along the edge and does not intersect the top and bottom surfaces and is sized to fit within said recess for securing said structural and cushioning materials together; and an outsole.

2. The multilayered sole according to claim 1, wherein said cushioning material extends a length of said midsole.

3. The multilayered sole according to claim 1, wherein said cushioning material extends a width of said midsole.

4. The multilayered sole according to claim 1, wherein said rigid member is placed in alternating fashion with said flexible member.

5. The multilayered sole according to claim 1, wherein said cushioning material is placed in alternating fashion with said structural material.

6. The multilayered sole according to claim 1, wherein said cushioning material is a gel and said structural material is leather.

7. A multilayered sole, comprising:

an insole having a plurality of members extending from a toe area to a heel area for enhancing flexibility;

said plurality of members includes a rigid member placed in alternating fashion with a flexible member;

a midsole having a plurality of materials extending from the toe area to the heel area for enhancing comfort;

said plurality of materials include a cushion material placed in alternating fashion with a structural material;

a hook and loop fastener placed between said structural and cushioning materials for securing said structural and cushioning materials together; and an outsole.

8. The multilayered sole according to claim 7, wherein said insole gradually transitions from said rigid member to said flexible member.

9. The multilayered sole according to claim 8, wherein a thickness of said rigid member is inversely proportional to a thickness of said flexible member in an area of gradual transition from said rigid member to said flexible member.

10. The multilayered sole according to claim 7, wherein said midsole gradually transitions from said cushion material to said structural material.

11. The multilayered sole according to claim 10, wherein a thickness of said cushion material is inversely proportional to a thickness of said structural material in an area of gradual transition from said cushion material to said structural material.

12. A multilayered sole, comprising:

an insole extending from a toe area to a heel area, said insole having a rigid member and a flexible member for enhancing flexibility;

a midsole extending from the toe area to the heel area, said midsole having a cushioning material and a structural material for enhancing comfort;

an outsole having a recess;

said recess extending laterally across said outsole;

said recess slopes downwardly toward a rear of said outsole;

said flexible member of said insole and said cushion material of said midsole placed proximate to said recess; and wherein said flexible member and said cushion material flex in cooperation with said recess for enhancing flexibility of the multilayer outsole.

13. The multilayered sole according to claim 12, further comprising a notch in a top surface of said outsole for enhancing flexibility.

14. The multilayered sole according to claim 12, further comprising a plurality of recesses.

15. The multilayered sole according to claim 12, wherein said recess is between a top surface and a bottom surface of said outsole.

16. The multilayered sole according to claim 12, wherein said recess extends from a top surface of said outsole toward a bottom surface of said outsole.

17. The multilayered sole according to claim 12, wherein said recess extends from a top surface of said outsole to a bottom surface of said outsole.

* * * * *